US005488850A

United States Patent [19]

Hasegawa et al.

[11] Patent Number: 5,488,850

[45] Date of Patent: Feb. 6, 1996

[54] METHOD FOR PRODUCING A CRYOSTATIC STABILIZER

[75] Inventors: Masahiro Hasegawa; Hitoshi Yasuda, both of Tsukuba; Akihiko Takahashi, Ryugasaki, all of Japan

[73] Assignee: Sumitomo Chemical Company, Limited, Osaka, Japan

[21] Appl. No.: 291,071

[22] Filed: Aug. 17, 1994

[30] Foreign Application Priority Data

Aug. 24, 1993 [JP] Japan ..... 5-209740

[51] Int. Cl.[6] ..... B21C 23/00

[52] U.S. Cl. ..... 72/253.1; 72/260

[58] Field of Search ..... 72/260, 264, 271, 72/700, 253.1; 174/125.1; 29/599

[56] References Cited

FOREIGN PATENT DOCUMENTS 0051674 1/1976 Japan ..... 29/599

0068763 6/1979 Japan ..... 72/253.1

54161570 12/1979 Japan .

OTHER PUBLICATIONS

Abstract: IEEE Transations Of Applied Super Conductivity, The UW–SMES Design, Roger W. Boom vol. 3, No. 1, pp. 320–327 (1993).

*Primary Examiner*—Daniel D. Crane
*Assistant Examiner*—Ed Tolan
*Attorney, Agent, or Firm*—Sughrue, Mion, Zinn, Macpeak & Seas

[57] ABSTRACT

Disclosure is a method for producing a cryostatic stabilizer composed of high-purity aluminum which comprises extruding the high-purity aluminum at an extrusion temperature of 250° to 500° C., an extrusion speed of not more than 20 m/min and an extrusion ratio of 10 to 150 by using an extruding machine equipped with a cylindrical die having helical grooves or projections on the inner surface. The method is industrially advantageous.

7 Claims, No Drawings

METHOD FOR PRODUCING A CRYOSTATIC STABILIZER

BACKGROUND OF THE INVENTION

1. Field of the Invention

The present invention relates to a method for producing a cryostatic stabilizer, composed of high-purity aluminum and used at ultra low temperatures.

2. Background of the Invention

In those facilities and equipment which utilize a superconductor, a conductor, generally called a cryostatic stabilizer, is provided on and around the superconductor to protect the superconductor by bypassing the electric current to the aluminum conductor around the superconductor region in the state of normal conductivity which occurs due to an external thermal, electric or magnetic disturbance.

DESCRIPTION OF THE RELATED ART

High-purity aluminum, because its electric resistivity is remarkably low at ultra low temperature and in magnetic field, has been discussed for possible use as such cryostatic stabilizer (Phys. Rev. B. Vol. 3, No. 6, 1971, p. 1941).

As a part of such trials, the use of the cryostatic stabilizer made of high-purity aluminum is planned for superconducting magnetic energy storage devices.

The cryostatic stabilizer employed in SMES (superconducting magnetic energy storage system) is used as a conductor composed of a superconductor and the cryostatic stabilizer by fixing the superconductor to the cryostatic stabilizer with soldering or the like. In order to uniformly keep the whole superconductor at ultra low temperatures, liquid helium needs to be sufficiently fed to the periphery of the superconductor. A cryostatic stabilizer having helical grooves or projections is devised as a structure therefor [IEEE TRANSACTIONS ON APPLIED SUPERCONDUCTIVITY, Vol. 3, No. 1, p. 320 (1993)].

A method which comprises for giving a twist to a cylindrical bar having straight grooves or projections at its both ends to provide helical grooves are known for obtaining the cryostatic stabilizer, composed of high-purity aluminum and having the helical grooves or projections.

A cryostatic stabilizer having helical grooves or projections at a uniform pitch throughout the whole, however, is not readily obtained according to the method mentioned above, and properties satisfactory for the cryostatic stabilizer cannot be directly accomplished by such method because electric resistance of the obtained cryostatic stabilizer at ultra low temperatures becomes too large for the practical use especially when the cross-sectional area of the cryostatic stabilizer is relatively small. Therefore, for lowering the electric resistivity at ultra low temperatures, it is necessary further to carry out the heat treatment after the method mentioned above, and a remarkable increase in cost cannot be avoided.

The object of the present invention is to provide an industrially advantageous method for producing a cryostatic stabilizer, composed of high-purity aluminum and having a low electric resistance at ultra low temperatures and helical grooves or projections without requiring any heat treatments. This and other objects and advantages will be apparent from the following description.

SUMMARY OF THE INVENTION

As a result of intensive research made on the method for producing the cryostatic stabilizer composed of high-purity aluminum, the present inventors have found that a cryostatic stabilizer having a low electric resistance at ultra low temperatures is advantageously obtained by extruding the high-purity aluminum under specific conditions using an extruding machine equipped with a die of a specified shape, and the present invention has been completed.

Thus, this invention relates to a method for producing a cryostatic stabilizer composed of high-purity aluminum which comprises extruding the high-purity aluminum at an extrusion temperature of 250° to 500° C., an extrusion speed of not more than 20 m/min and an extrusion ratio of 10 to 150 by using an extruding machine equipped with a cylindrical die having helical grooves or projections on the inner surface.

This invention is illustrated hereinafter.

The high-purity aluminum used in this invention has a purity of at least 99.9% by weight. When aluminum having lower purity than 99.9% by weight is used, its electric resistance at ultra low temperature can't be lowered to such an extent as to be usable for the cryostatic stabilizer. Therefore, such aluminum having lower purity than 99.9% by weight is unsuitable as the cryostatic stabilizer. The purity of the high-purity aluminum is usually 99.9 to 99.9999% by weight, preferably 99.99 to 99.9999% by weight from aspects of industrial production and performances as the cryostatic stabilizer.

In the present invention, the purity of the high-purity aluminum means weight % obtained by deducting, from 100, weight % of metallic and semi-metallic elements other than aluminum which are detected by, for example, GDMS (Glow Discharge Mass Spectroscopy).

The extruding machine used herein is equipped with, for example, a cylindrical die having helical grooves or projections on the inner surface thereof.

The pitch of the helical grooves or projections of the die is usually 5 inches/1 turn to 50 inches/1 turn. The pitch of the helical grooves or projections thereof is sufficiently at the pitch of 5 inches/1 turn from the viewpoint that the cryostatic stabilizer effectively acts on cooling. When the pitch is smaller than 5 inches/1 turn, the die is not advantageous to its productivity. When the pitch is larger than 50 inches/1 turn, there is little difference from that of straight grooves or projections in cooling efficiency.

The number of the grooves or projections of the die, the width of the projections or distance between the adjacent grooves, the height of the projections, the depth of the grooves, shape of the grooves or projections or the like can be suitably determined according to the shape of the applied SMES conductor. The number of the grooves or projections of the die is usually 2 to 100, preferably 4 to 100. Since the diameter of the superconductor used for the conductor is usually about 1 to 10 mm, the width of the projections or the distance between the adjacent grooves is usually about 1.1 times or above that of the superconductor. The height of the projections or depth of the grooves of the die is usually about 1 to 10 mm.

The diameter (maximum diameter) of the die opening can be suitably determined according to the electric current applied in the stabilizer. The cryostatic stabilizer according to the method of the present invention can be applied even to the one having a diameter of about 100 mm or below which cannot be used without heat treatment in conventional method. Thus, this method is especially useful for producing the cryostatic stabilizer having a diameter of about 100 mm or below.

As the extrusion method with the extruding machine, for example, direct, indirect or hydraulic extrusion methods, continuous extrusion forming methods or the like can be applied. Among them, the direct extrusion method is preferred.

The cryostatic stabilizer, composed of the high-purity aluminum and having a shape corresponding to, for example, a cylindrical die having helical grooves or projections on the inner surface is obtained by using an extruding machine equipped with the die as mentioned above.

The extrusion ratio [cross-sectional area of upset ingot/cross-sectional area of extrusion] in the present invention is 10 to 150. If the cryostatic stabilizer is produced at an extrusion ratio below 10, the cryostatic stabilizer having uniform electric resistance at ultra low temperatures can't be obtained. If the extrusion ratio exceeds 150, the helical grooves or projections of the cryostatic stabilizer are not sufficiently produced. The extrusion ratio is preferably 20 to 100.

The extrusion temperature in the present invention is 250° to 500° C. If the temperature is below 250° C., the electric resistance of the cryostatic stabilizer at ultra low temperatures is too large, and a satisfactory cryostatic stabilizer can't be obtained without heat treatment. If the extrusion temperature exceeds 500° C., the stiffness of the material is lowered, and helical projections or grooves having the objective pitch cannot be formed. The extrusion temperature is preferably 300° to 450° C.

The extrusion speed in the present invention is not more than 20 m/min. If the extrusion speed exceeds 20 m/min, cracking occurs, and a satisfactory shape of the cryostatic stabilizer is not obtained. The optimum speed according to the objective pitch can be suitably selected, and the extrusion speed is usually 0.1 to 20 m/min, preferably 0.2 to 10 m/min in its productivity.

Since the cryostatic stabilizer extruded from the outlet of the extruding machine can be extruded rotationally according to the pitch of the die, the cryostatic stabilizer is preferably led out according to the rotational pitch of the extrusion and the leading out is effective in uniformizing the pitch of the helical projections or grooves of the resulting cryostatic stabilizer. The leading out may be carried out by selecting a proper speed according to the pitch of the helical projections or grooves.

The residual resistivity ratio of the cryostatic stabilizer in the present invention is a value represented by A/B when the electric resistance of a sample bar having a diameter of 25.4 mm and a length of 150 mm at room temperature (296 K) is A and the electric resistance thereof at the ultra low temperature (4.2 K) is B.

A sample having a diameter of 25.4 mm and a length of 150 mm was heat-treated at 500° C. in the air for 3 hours and then was returned to the room temperature over a period of 24 hours. The electric resistance of the resultant sample at 296 K is A' and the electric resistance at 4.2 K is B'. The residual resistivity ratio of the raw material is a value represented by A'/B'.

It is preferable that the cryostatic stabilizer, composed of the high-purity aluminum and having helical projections or grooves maintains the residual resistivity ratio of the raw material as it is; however, it is unavoidable that the residual resistivity ratio is lowered by the strain produced in extrusion working.

The cryostatic stabilizer composed of the high-purity aluminum according to the present invention has a residual resistivity ratio (A/B) of 50% or above based on that of the raw material (A'/B'), and provide a sufficiently permissible electric resistance for practical use at ultra low temperatures. If the residual resistivity ratio (A/B) is below 50% based on that of the raw material (A'/B'), the electric resistance at ultra low temperatures is too large for practical use.

According to the present invention, the excellent cryostatic stabilizer, composed of the high-purity aluminum and having a low electric resistance at ultra low temperatures can be industrially and advantageously obtained without requiring a heat-treating step.

DESCRIPTION OF THE PREFERRED EMBODIMENTS

This invention is illustrated by citing the following Examples, which are not construed as limiting the invention.

EXAMPLE 1

An extruding machine (1500-ton extruding machine, manufactured by NIHON TEKKO, Ltd.) equipped with a cylindrical die (material: JIS. SKD61) having the opening diameter of 25.4 mm and 8 helically (pitch: 15 inches/1 turn) engraved projections [projection width: 4 mm; distance between the projections (projection bottom): 6 mm; projection height: 4.5 mm] at a regular interval on the inner surface was used to extrude a billet having a diameter of 155 mm (aluminum purity: 99.9996% by weight) at an extrusion temperature of 400° C. and an extrusion speed of 0.6 m/min. Thereby, a bar of the high-purity aluminum having an outside diameter of 25.4 mm, a purity of 99.9996% by weight and 8 helical grooves [pitch: 15 inches/1 turn groove bottom width: 4 mm, distance between the grooves (groove top): 6 mm; groove depth: 4.5 mm] at a regular interval was produced, and a sample of 150 mm long was cut from the bar. The electric resistance of the resulting sample was measured in liquid helium (4.2 K) and room temperature (296 K) by a potentiometric method with a dc comparator potentiometer (Guildline, Model 9930) to obtain the residual resistivity ratio (electric resistance at 296 K/electric resistance at 4.2 K). The results are shown in Table 1.

COMPARATIVE EXAMPLE 1

An extruding machine (1500-ton extruding machine, manufactured by NIHON TEKKO, Ltd.) equipped with a cylindrical die having the opening diameter of 25.4 mm and 8 straight engraved grooves [projection width: 4 mm, distance between the projections (projection bottom): 6 mm; projection depth: 4.5 mm] on the inner surface was used to extrude a billet having a diameter of 155 mm (aluminum purity: 99.9996% by weight) at an extrusion temperature of 260° C. and an extrusion speed of 15 m/min. Thereby, a bar of the high-purity aluminum having an outside diameter of 25.4 mm and a purity of 99.9996% by weight and 8 straight grooves [groove top width: 4 mm; distance between the grooves (groove top): 6 mm; groove depth: 4.5 mm] at a regular interval was produced, and a bar having a groove pitch of 15 inches/1 turn was obtained by giving a twist to the bar at both ends. A sample of 150 mm long was cut from the bar, which was measured in the same manner as in Example 1. The results are shown in Table 1.

TABLE 1

| | Raw material | | | Grooved bar | | |
|---|---|---|---|---|---|---|
| | Electric Resistance at 296 K (nΩ) | Electric Resistance at 4.2 K (nΩ) | Residual resistivity ratio | Electric Resistance at 296 K (nΩ) | Electric Resistance at 4.2 K (nΩ) | Residual resistivity ratio |
| Example 1 | 7770 | 1.04 | 7471 | 8250 | 1.53 | 5392 |
| Comparative Example 1 | 7770 | 1.04 | 7471 | 5060 | 3.41 | 1483 |

As can be seen from Table 1, the residual resistivity ratio in using the cylindrical die having the helically engraved grooves on the inner surface (Example 1) was 3.6 times (5392÷1483) of that in using the cylindrical die having the rectilinearly engraved grooves (Comparative Example 1). In Example 1, the residual resistivity ratio was 72% (5392÷7471×100) based on that of the raw material. On the other hand, the residual resistivity ratio in Comparative Example 1 was 20% (1483÷7471×100) based on that of the raw material.

What is claimed is:

1. A method for producing a cryostatic stabilizer having helical grooves or projections composed of high-purity aluminum which comprises extruding the high-purity aluminum at an extrusion temperature of 250° to 500° C., an extrusion speed of not more than 20 m/min and an extrusion ratio of 10 to 150 by using an extruding machine equipped with a cylindrical die having helical grooves or projections on the inner surface of the die so as to produce helical grooves or projections on the cryostatic stabilizer.

2. The method according to claim 1, wherein the pitch of the helical grooves or projections produced in the stabilizer is 5 inches/1 turn to 50 inches/1 turn.

3. The method according to claim 1, wherein the extrusion ratio is 20 to 100.

4. The method according to claim 1, wherein the extrusion temperature is 300° to 450° C.

5. The method according to claim 1, wherein the extrusion speed is 0.1 to 20 m/min.

6. The method according to claim 1, wherein the extrusion speed is 0.2 to 10 m/min.

7. The method according to any of claims 1 to 6, wherein the residual resistivity ratio of said cryostatic stabilizer is not less than 50% or above based on that of its raw material.

* * * * *